United States Patent [19]

Podrini

[11] Patent Number: 4,645,575

[45] Date of Patent: Feb. 24, 1987

[54] PROCESS FOR THE CONTINUOUS ELECTRODEPOSITION OF METALS AT HIGH CURRENT DENSITY IN VERTICAL CELLS

[75] Inventor: Maurizio Podrini, Rome, Italy

[73] Assignee: Centro Sperimentale Metallurgico S.p.A., Rome, Italy

[21] Appl. No.: 756,093

[22] Filed: Jul. 17, 1985

[30] Foreign Application Priority Data

Jul. 24, 1984 [IT] Italy ..... 48617 A/84

[51] Int. Cl.[4] ..... C25D 7/06

[52] U.S. Cl. ..... 204/28

[58] Field of Search ..... 204/28

[56] References Cited

U.S. PATENT DOCUMENTS 4,518,474 5/1985 Podrini ..... 204/206

4,526,668 7/1985 Podrini ..... 204/206

FOREIGN PATENT DOCUMENTS 2147009 5/1985 United Kingdom ..... 204/28

*Primary Examiner*—T. M. Tufariello

*Attorney, Agent, or Firm*—Young & Thompson

[57] ABSTRACT

Process for the continuous electrodeposition of metals at high current density in vertical cells, wherein the body to be plated, usually metal strip, follows first a decending path and then an ascending one, during both of which it traverses at least one electrolytic deposition cell through which is passed an electrolyte in turbulent flow, moving in the opposite direction in the descending stretch to that in the ascending stretch, so that in both stretches the fluid dynamics conditions are very uniform. Turbulent flow is induced, by creating a partial vacuum in each cell by educting a flow of electrolyte at one end of each cell in a vertical direction away from the cell. Preferably, the educed flow of electrolyte is countercurrent to the direction of strip movement.

2 Claims, 1 Drawing Figure

Figure 1:
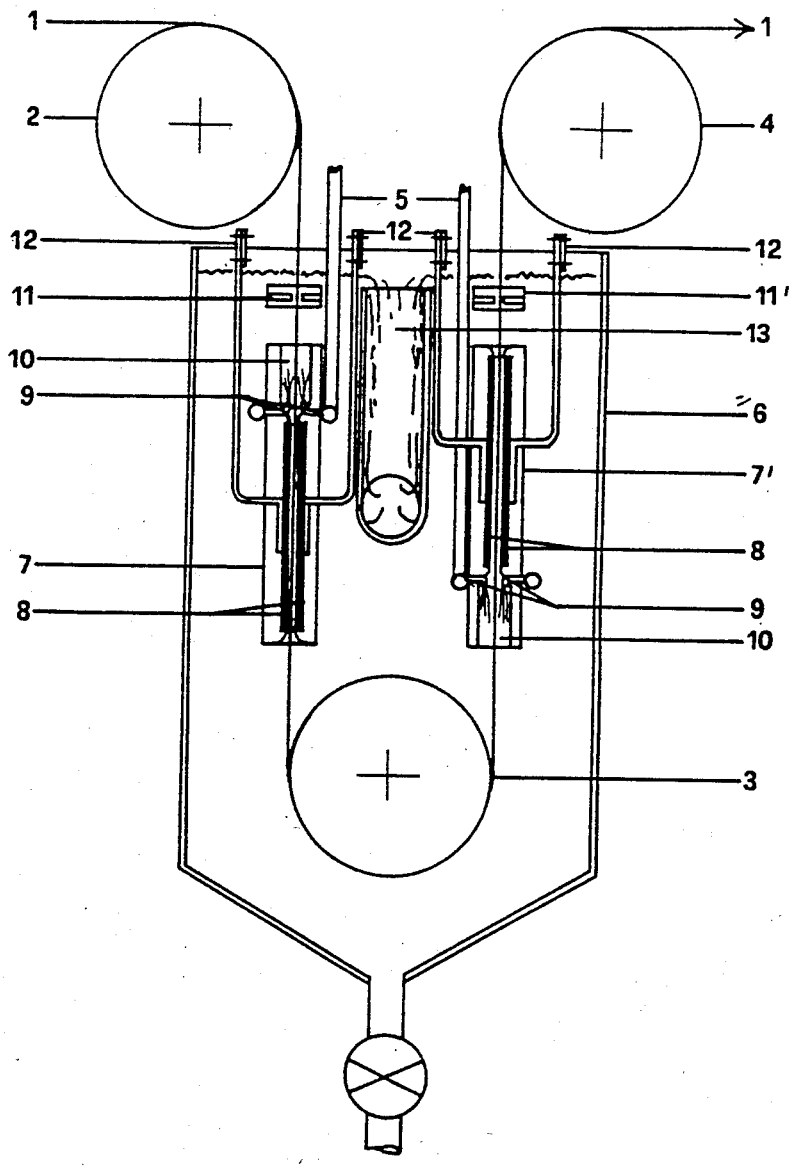

PROCESS FOR THE CONTINUOUS ELECTRODEPOSITION OF METALS AT HIGH CURRENT DENSITY IN VERTICAL CELLS

DESCRIPTION

The present invention relates to a process for the continuous electrodeposition of metals at high current density in vertical cells. More precisely it relates to the electrocoating of metal strip with one or more metals at high current density in treatment cells designed to ensure uniformity of fluid dynamics conditions and of relative motion between electrolyte and metal strip.

Electrolytic processes have been firmly established for quite some time now for coating metal strip with protective substances, especially with other metals. However, the processes are often far too slow to satisfy the needs of modern high-production industrial units, so costs tend to be higher than they should be.

In recent years, too, coatings consisting not of one metal but of at least two metals which are electrocodeposited have been developed. Zn-Fe and Zn-Ni coatings appear to be especially promising in this respect.

These technological trends, involving high current density electrocoating on the one hand and electrocodeposition of different metals on the other, pose a series of technical problems of various kinds that are sometimes difficult to reconcile.

For instance, the need to boost the productivity of electroplating lines means that the speed of the strip has to be increased, sometimes to over 150 m/min. so the current density ($A/dm^2$) used in the electrolytic cells must also be raised. This, in turn exacerbates the electrodeposition problems, because as the current density increases so does the rate at which the metal ions present in the electrolyte are deposited on the strip; this results in the electrolyte nearest the strip being impoverished compared with the remainder of the bath. When the current density is raised above a given level, the rate of deposition exceeds the rate at which the metal ions move from the main body of the solution to the vicinity of the strip. This situation results in a drastic reduction in the efficiency of electroplating and the speed of the process, so the results are clearly just the opposite of those desired.

It has been found that to overcome this difficulty the flow of the electrolyte must be fairly turbulent, essentially to minimize the thickness of the impoverished zone of electrolyte in contact with the strip.

Various devices have been tried to achieve this result, all based on the concept of forcing the electrolyte into the space between the strip (cathode) and the anodes. These devices are either of the horizontal type in which the strip passes through a cell whose longest dimension is horizontal, or else they are of the vertical type, in which the strip is deflected downwards to enter a bath with a return roll at the bottom which sends the strip upwards again. Hence the strip follows two paths, one descending and the other ascending, through the electrolytic cells.

The advantage of the horizontal arrangement is that the plant is simpler than in the case of the vertical arrangement which, however, ensures a more compact line.

One drawback of the horizontal arrangement is that the metal strip running horizontally tends to form a catenary and so it is not the same distance at all points from both electrodes; this not only results in uneven deposition but, in some instances, also leads to the onset of oscillations that affect the strip in the cell, and can result in the strip short-circuiting with the electrodes. These drawbacks are reduced by adopting devices in which the electrolyte is force fed from the centre of the electrodes, thus forming a kind of hydraulic cushion which supports the strip at the maximum sag of the catenary, while also tending to dampen oscillations. However, with this solution it is evident that the electrolyte flow in the electrolytic cells is partly in the same direction as the strip and partly countercurrent thereto.

Plants using the vertical arrangement do not suffer from the catenary problem and the oscillation difficulty is also reduced. However, precisely because of their natural arrangement, the electrolyte either flows downwards in the cells by gravity or is forced from the bottom to the top, by pumps, for instance. In this way, as already remarked, since the strip in these devices follows a path which is first directed downwards and then upwards, the relative motion between strip and electrolyte is, of course, countercurrent in one cell and equicurrent in the other.

While such a situation may be tolerable in the case of electroplating with a single metal—though there must inevitably be differences in coating yields and efficiences under the countercurrent and the equicurrent flow conditions—it is completely unacceptable in the case of electrocodeposition, since it has been amply demonstrated that the composition of a mixed electrolytic deposit depends closely on the fluid dynamics conditions at the strip/electrolyte interface. In the case, therefore, of electrocodeposition, with modern high current density procedures and with existing or proposed plants, in every equicurrent flow stretch the coating would have a different composition from that in the countercurrent stretch. To conclude, therefore, at the present time, with the latest high current density electrolytic deposition plants (above 100 $A/cm^2$, and with up to 180 $A/dm^2$ proposed) coatings involving one single metal may be somewhat unsatisfactory at times as regards appearance and/or quality, owing to the different fluid dynamics conditions in the two halves of a horizontal cell or in the pairs of vertical cells, while, for the same reasons electrocodeposition results in nonuniform coatings of diverse composition. Hence, to date, in order to perform electrocodepositions it has been necessary either to use low current density lines (less than about 80 $A/dm^2$) which are thus slow, so productivity is lost, or to use modern vertical cell plants where one of each pair of cells must be excluded (the strip being treated either only on the downward stretch or only on the upward one), thus losing the advantage of compactness offered by such plants.

The object of the present invention is to overcome all the above difficulties by making available a process to ensure substantially uniform fluid dynamics conditions in the electrolyte in vertical tank plants and also uniform relative velocity between strip and electrolyte in the pair of cells of each device operating at high current density.

Another object of this invention is, consequently, to ensure excellent uniformity of the resulting coatings, both in the case of deposition of one metal only and in the case of codeposition of diverse metals.

Yet another object of the invention is to provide a process capable of permitting very uniform, good quality electrodepositions or electrocodepositions, as the case may be, at high current density.

The process, which is the subject of this invention, is extremely simple yet highly ingenious. It is characterized by the fact that, in continuous high-current density electrodeposition of metals on metal strip, where the strip to be coated travels first down a descending stretch and then up an ascending one in each of the treatment units, passing in each of said stretches through an electrolytic deposition cell through which flows the electrolyte for electrodeposition, said electrolyte is forced to flow turbulently and vertically in the cells, the direction of flow in the descending stretch being opposite that in the ascending one.

The electrolyte is preferably forced to pass countercurrent to the strip in the cells.

A device for practicing the process described above is, in its turn, characterized by the fact that the electrolytic cells of the descending stretch and those of the ascending one are equipped with means—the same for both—to ensure intense movement of electrolyte within the cells, said means being inserted in each cell near the same extremity thereof, namely near the side where either the strip enters the cells or leaves them.

In this way it is possible to ensure that the direction of movement of the electrolyte relative to that of the strip is the same in the cell with the descending stretch as it is in that with the ascending one. Turbulent flow of electrolyte in the cells can be achieved either by a force pump or by a suction pump (which can be of the ejector type, for instance).

If it is wished, as is preferable, to have countercurrent motion between the electrolyte and strip, the delivery of the force pumps, of course, must be near the side from which the strip leaves the cells and must deliver the electrolyte into the cells; on the contrary, in the case of suction pumps, these must have the suction in the cells near the side where the strip enters the cells, and must suck the electrolyte from the cells.

In small-scale tests that have been performed, current densities of up to 250 $A/dm^2$ have been achieved with strip speeds of between 2 and 20 m/min. The test produced, for instance, uniform, compact deposits of zinc weighing between 15 and 100 $g/m^2$, and compact codeposits of zinc and iron of uniform composition consisting of between 10 and 75% Fe (by weight), depending on the current density used and the relative velocity between strip and electrolyte, as well as the composition of the electrolyte itself.

The present invention will now be described, purely by way of exemplification which must in no way be construed as limiting, by reference to a possible embodiment illustrated schematically in the accompanying drawing.

The strip 1, which moves generically from left to right, as indicated, is deflected downwards by roller 2 and enters tank 6 filled with electrolyte, moves down through the first cell 7, is diverted upwards by roller 3, through the second cell 7' and leaves tank 6, at which point it is deflected to the horizontal position by roller 4.

The strip is connected electrically, through current-carrying rollers (which can be rollers 2, 3 and 4), to the negative pole of a dc electric circuit and thus acts as the cathode, the positive pole of said circuit being connected to anodes 8 through the busbars 12; the circuit is closed, of course, by the electrolyte in the space between the strip (cathode) and anodes 8 of each cell.

On the side where the strip enters the cells each of these has an ejector device schematized by the empty chamber 10 and by the ejectors 9, pressure fed via the supply lines 5, supplied in turn by the overflow 13 in tank 6. Items 11 and 11' are protected devices needed, respectively, to prevent electrolyte from being thrown out of tank 6, by cell 7 and to prevent air being sucked into cell 7'. When anodes 8 are of the insoluble type, it is necessary to connect a reactor between overflow 13 and electrolyte-supply pipes 5 to restore the required concentration of metal ions in the electrolyte for deposition, and perhaps to adjust the pH and make such composition corrections as may be needed.

During operation a partial vacuum is created in chamber 10 owing to the flow of electrolyte fed by ejectors 9 and directed towards the outside of the cells; this partial vacuum draws in other electrolyte violently through the cells with turbulent flow. As will be readily appreciated, with the arrangement illustrated, the electrolyte will be drawn from bottom to top in cell 7 and from top to bottom in cell 7'. The desired and necessary parity of fluid dynamics conditions in thus assured in both cells.

I claim:

1. In a process for the continuous electrodeposition of metals at high current density on metal strip in vertical cells, wherein the strip to be coated runs down a descending stretch and then up an ascending one in each of the treatment units and travels, in each stretch, through at least one electrolytic cell containing an electrolyte; the improvement comprising creating a partial vacuum in each cell by educting a flow of said electrolyte at one end of each cell in a vertical direction away from the cell, whereby the electrolyte for electrodeposition is forced to pass through each cell turbulently and vertically, the direction of flow of said electrolyte in the descending stretch being opposite that in the ascending one.

2. Process for the continuous electrodeposition of metals at high current density on metal strips as per claim 1, characterized by the fact that in each cell the electrolyte is forced by said eduction to pass countercurrent to the strip.

* * * * *